US009937617B2

(12) United States Patent
Martin

(10) Patent No.: US 9,937,617 B2
(45) Date of Patent: Apr. 10, 2018

(54) MARKING TEMPLATE FOR MARKING PIPE, TUBING AND BARS PRIOR TO BENDING

(71) Applicant: Thomas Martin, Newtown, PA (US)

(72) Inventor: Thomas Martin, Newtown, PA (US)

( * ) Notice: Subject to any disclaimer, the term of this patent is extended or adjusted under 35 U.S.C. 154(b) by 118 days.

(21) Appl. No.: 15/179,934

(22) Filed: Jun. 10, 2016

(65) Prior Publication Data

US 2017/0355075 A1 Dec. 14, 2017

(51) Int. Cl.
*B25H 7/00* (2006.01)
*B25H 7/04* (2006.01)

(52) U.S. Cl.
CPC ..... *B25H 7/045* (2013.01); *B25H 7/005* (2013.01)

(58) Field of Classification Search
CPC ..... B25H 7/045; B25H 7/005
USPC ..... 33/566, 21.1, 21.3, 562, 563
See application file for complete search history.

(56) References Cited

U.S. PATENT DOCUMENTS 660,688 A * 10/1900 Lipsy ..... G01B 5/252 33/21.1
1,535,980 A * 4/1925 Campbell ..... B25H 7/005 33/1 R
1,610,193 A * 12/1926 Battle ..... G01B 3/04 33/21.3
1,778,981 A * 10/1930 McLaughlin ..... E21B 47/00 33/21.3
3,060,587 A 10/1962 Picken
3,200,505 A 8/1965 Hedges
3,209,459 A * 10/1965 Fish, Jr. ..... B23D 51/025 33/529
4,653,195 A * 3/1987 Esparza ..... B23K 7/10 266/64
5,447,057 A * 9/1995 Shaw ..... G01N 17/00 73/86
5,450,677 A * 9/1995 Casey ..... B25H 7/005 33/373
5,768,790 A 6/1998 Norman
6,470,586 B2 10/2002 Kneipp
6,560,887 B2 5/2003 Byrnes
6,996,911 B1 2/2006 Dinius
7,251,902 B1 8/2007 Mueller
7,624,511 B1 12/2009 Schmidt
8,296,959 B1 * 10/2012 Brooks ..... B25H 7/005 33/21.1
2006/0225291 A1 * 10/2006 Marks ..... B43L 13/20 33/21.3

* cited by examiner

*Primary Examiner* — Christopher Fulton
(74) *Attorney, Agent, or Firm* — LaMorte & Associates P.C.

(57) ABSTRACT

A device and method of marking an elongated element for bending. A template is provided that has a body with a first end, an opposite second end, a first side edge, and a second side edge. The body also includes a concave surface that extends between the first end and the second end. Length indicia are disposed on the body adjacent the first straight side edge. Angle indicia are disposed on the body adjacent the first end. Utilizing a marker and the template, a start line and a finish line are marked onto the elongated element. Additionally, a guideline is marked on the elongated element that extends from the start line to the finish line. At least one bend is formed in the elongated element between the start line and the finish line. The bends progress along the marked guideline.

19 Claims, 7 Drawing Sheets

MARKING TEMPLATE FOR MARKING PIPE, TUBING AND BARS PRIOR TO BENDING

BACKGROUND OF THE INVENTION

1. Field of the Invention

In general, the present invention relates to templates and jigs that are used to mark and measure, pipes, tubes and/or bars prior to being subjected to bending for the purpose of obtaining more precise bends. More particularly, the present invention relates to templates and jigs that are temporarily applied to the exterior of a pipe, tube, or bar for the purpose of making marks on the surface of the pipe, tube or bar.

2. Prior Art Description

In modern day construction, many craftsmen are required to bend pipes, tubes, and bars. For example, plumbers often bend pipes, such as gas pipes, to make the pipes better fit a particular installation. The bending of a pipe is much quicker and easier than cutting the pipe and adding angled joints to the pipe. The bending of the pipe also is more reliable because there is no danger of an installed joint leaking.

Electricians often bend metal conduits through which electrical wires run. Such conduits often contain complex bends to facilitate the running of wires along walls and through small utility spaces. Concrete workers often bend rebar so that the rebar conforms to the shape of the support framework being formed in a concrete structure.

Regardless of the usage, pipes, tubes, and bars are typically bent using a bending tool. Many commercial bending tools are available in commerce. Some bending tools are manual, some are powered. However, with few exceptions, bending tools only create a single bend in a pipe, tube, or bar. If complex bends are to be made, the pipe, tube or bar must be set into the bending tools multiple times, wherein the complex bends are achieved one bend at a time.

A common problem that occurs when a bending tool is repeatedly used to make multiple bends is one of maintaining planar orientation throughout the bends. When a bend is created in a pipe, tube, or bar, that bend is symmetric in only one plane. In order for the pipe, tube, or bar to stay in one plane, all subsequent bends must occur in the exact same plane as the plane of the first bend. If there is only a slight rotation out of the plane in any of the subsequent bends, then the pipe, tube, or bar will not progress in a single plane and will not run flat along a floor, wall, or other planar surface.

In the prior art, some templates are designed to mark pipes, tubes, and bars. However, these templates are primarily designed for marking the pipe, tube, or bar for cutting. Such prior art templates are exemplified by U.S. Pat. No. 7,251,902 to Mueller. Although such templates can be used to create marks that are useful in bending, the marks are oriented poorly for bending and would be of little assistance in creating a complex bend.

A need therefore exists for a template device that is specifically designed to assist a person marking a pipe, tube, or bar in order to accurately produce a complex bend in that pipe, tube, or bar. This need is met by the present invention as described and claimed below.

SUMMARY OF THE INVENTION

The present invention is a device and method of marking an elongated element for bending. A template is provided for use in marking the elongated element. The template has a body with a first end, an opposite second end, a first straight side edge, and a second straight side edge. The first straight side edge and the second straight side edge are parallel and extend from the first end to the second end of the body. The body also includes a concave surface that extends between the first end and the second end.

Length indicia are disposed on the body adjacent the first side edge. Furthermore, an angle indicia is disposed on the body adjacent the first end.

The template is placed in abutment with said elongated element. Utilizing a marker and the template, a start line and a finish line are marked onto the elongated element. Additionally, a guideline is marked on the elongated element that extends from the start line to the finish line.

Using the markings, at least one bend is formed in the elongated element between the start line and the finish line. The bends progress along the marked guideline.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention template device can be embodied in many ways, the embodiment illustrated shows only one exemplary embodiment of the template device. This embodiment is selected in order to set forth one of the best modes contemplated for the invention. The illustrated embodiment, however, is merely exemplary and should not be considered a limitation when interpreting the scope of the appended claims.

Figure 1:
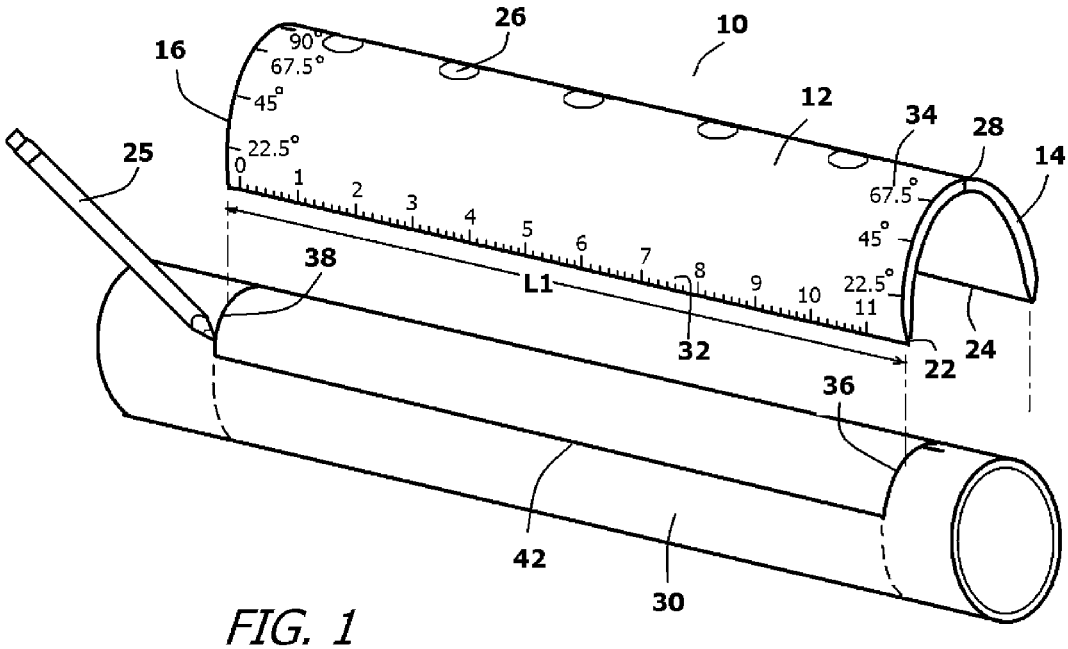
FIG. 1 is a perspective view of an exemplary embodiment of a template device shown in conjunction with a segment of pipe and a marking pencil.
Figure 2:
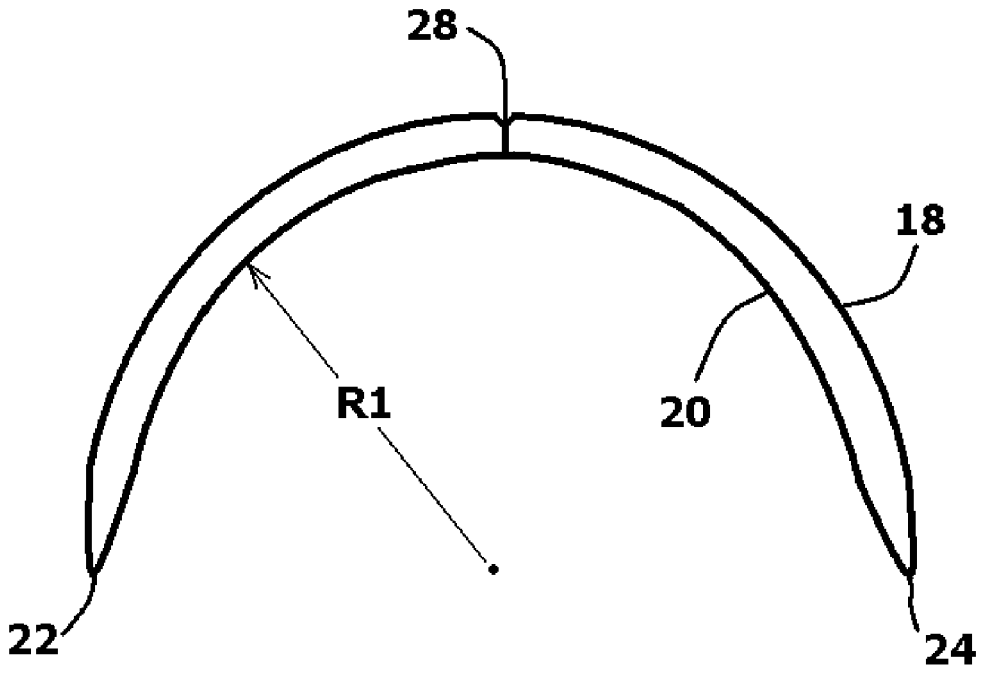
FIG. 2 is a side view of the exemplary embodiment of the template device shown in FIG. 1.

Referring to FIG. 1 and FIG. 2, a template device 10 is shown. The template device 10 has a body 12 that is shaped as a segment of a bifurcated tube. The body 12 of the template device 10 has a semicircular cross-sectional profile that extends a length L1 between a first semicircular end 14 and a second semicircular end 16. Accordingly, the body 12 of the template device 10 has a convex exterior surface 18 and a concave interior surface 20 that extends between the first semicircular end 14 and the second semicircular end 16. Laterally, the convex exterior surface 18 and the concave interior surface 20 run between a first straight side edge 22 and a second straight side edge 24. The two straight side edges 22, 24 are parallel to each other and are perpendicular to the two semicircular ends 14, 16.

Both the first straight side edge 22 and the second straight side edge 24 run the full length L1 of the body 12. As viewed in FIG. 2, the first straight side edge 22 and the second straight side edge 24 are radially 180 degrees apart. Furthermore, it can be seen that body 12 of the template device 10 tapers toward the first straight side edge 22 and the second straight side edge 24. This makes it easier to draw a pencil or similar marking device 25 along either the first straight side edge 22 or the second straight side edge 24.

The body 12 is curved when viewed from either semicircular end 14, 16. The radius R1 of the curvature is preferably only slightly larger than the radius of the pipe, tube, or bar 30 that is to be bent. In this manner, the body 12 of the template device 10 fits securely over the exterior of the pipe, tube or bar 30 to be bent. It will therefore be understood that template devices having bodies with different interior radii are preferably used on pipes, tubes and rods with different exterior radii. The template device 10 is selected to match the size of the pipe, tube, or bar 30.

Magnets 26 are set into the body 12 of the template device 10. The magnets 26 enable the template device 10 to magnetically adhere to pipes, tubes, and bars 30 that are ferromagnetic. In the shown embodiment, individual magnets 26 are set into the body 12 of the template device 10. However, it should be understood that the body 12 of the template device 10 itself can be magnetized if it is fabricated from a ferromagnetic material or is internally coated with a ferromagnetic impregnated polymer.

A center mark 28 is formed at the apex of both semicircular ends 14, 16 of the body 12.

The center mark 28 can be printed or may be a physical slot or notch. Scale indicia are printed on the convex exterior surface 18 of the body 12. The scale indicia includes a length scale 32 and a rotational angle scale 34. The length scale 32 runs along each straight side edge 22, 24 of the body 12. The angle scale 34 runs adjacent the first semicircular end 14 and the second semicircular end 16. The rotational angle scale 34 shows that the center mark 28 is 90 degrees along the curved body 12 from either of the straight side edges 22, 24.

Figure 3:
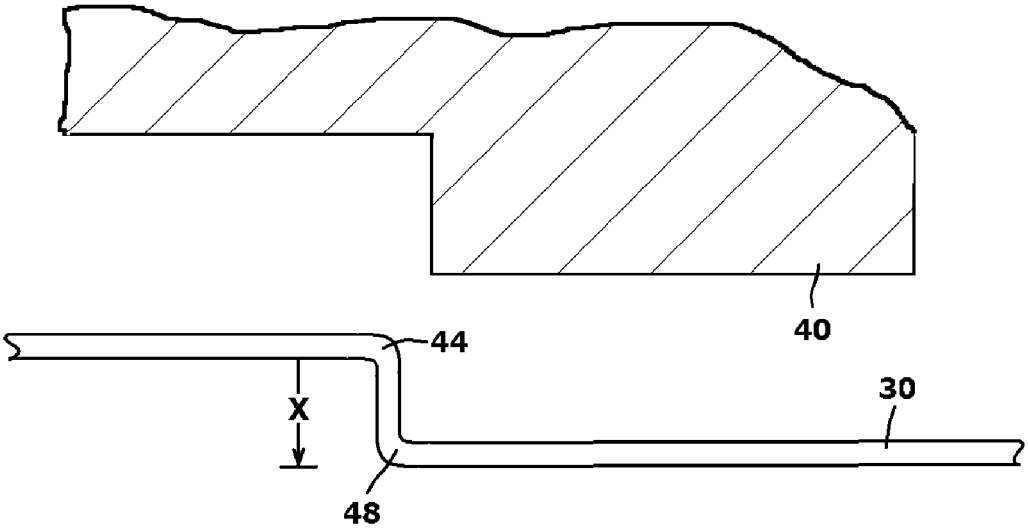
FIG. 3 shows a segment of bent pipe and a segment of contoured area around which the bent pipe is to be fit.

Referring to FIG. 3 in conjunction with FIG. 1, a first example is provided that explains the method of utilizing the template device 10. In FIG. 3, there is a complex surface 40 against which a person wants to run a pipe, tube or bar 30. The pipe, tube or bar 30 must therefore be bent to match the contours of the complex surface 40. As is illustrated in the example, the complex surface 40 will require the pipe, tube or bar 30 to be bent in two places in order for the pipe, tube or bar 30 to match the shape profile. The two bends must be offset by a distance "X", as shown in FIG. 3. For the sake of providing an example, it is herein assumed the length "X" is four inches.

Every bend in a pipe, tube or bar 30 takes a certain length of the pipe, tube or bar 30 to accomplish. The length required depends upon the angle of the bend, the diameter of the pipe, tube or bar 30 and the material of the pipe, tube, or bar 30. For the sake of discussion, it is assumed that the illustrated length of pipe, tube, or bar 30 requires three inches to achieve a 90 degree bend.

In the first step, a person determines by observation that there are two 90 degree bends that needed to be made. This will require six inches of the pipe, tube or bar 30 (3 inches×2). In addition, the offset between the bends is the distance "X", which is four inches for the example being made. As such, the entire bend will require ten inches of the pipe, tube or bar 30 (3 inches+3 inches+4 inches).

In the second step, a person determines if each of the bends occurs in the same plane or if any bend moves out of the initial plane. In the shown embodiment, both bends occur in a common plane. With this information, the user marks the pipe, tube or bar 30 using the template device 10. The user first marks a start line 36 where the bend is to begin. This is done by placing the template device 10 over the pipe, tube or bar 30 and running a pencil or other marker 25 along one end. The start line 36 can be made to circumvent the pipe, tube or bar 30 by first placing the template device 10 on one side of the pipe, tube or bar 30 and then moving the template device 10 to the opposite side. By making two pencil marks, a complete circle can be marked at the starting line 36. A center mark along the start line 36 is also noted by creating a mark on the pipe, tube or bar 30 adjacent the center mark 28. Using the length scale 32 along one of the straight side edges 22, 24, the user then measures the required ten inches for the bend along the length of the pipe, tube or bar 30. The user then marks a finish line 38 on the pipe, tube or bar 30 by again running a pencil along the second semicircular end 16. The finish line 38 can also be made as a complete circle by reversing the position of the template device 10. The center of the finish line 38 is also demarcated by referencing the center mark 28 at the apex of the second semicircular end 16.

In addition to marking the finish line 38, the user also draws a guideline 42 between the start line 36 and the finish line 38. If two bends are to be in the same plane, the guideline 42 is straight and is parallel to the axis of the pipe, tube or bar 30.

Figure 4:
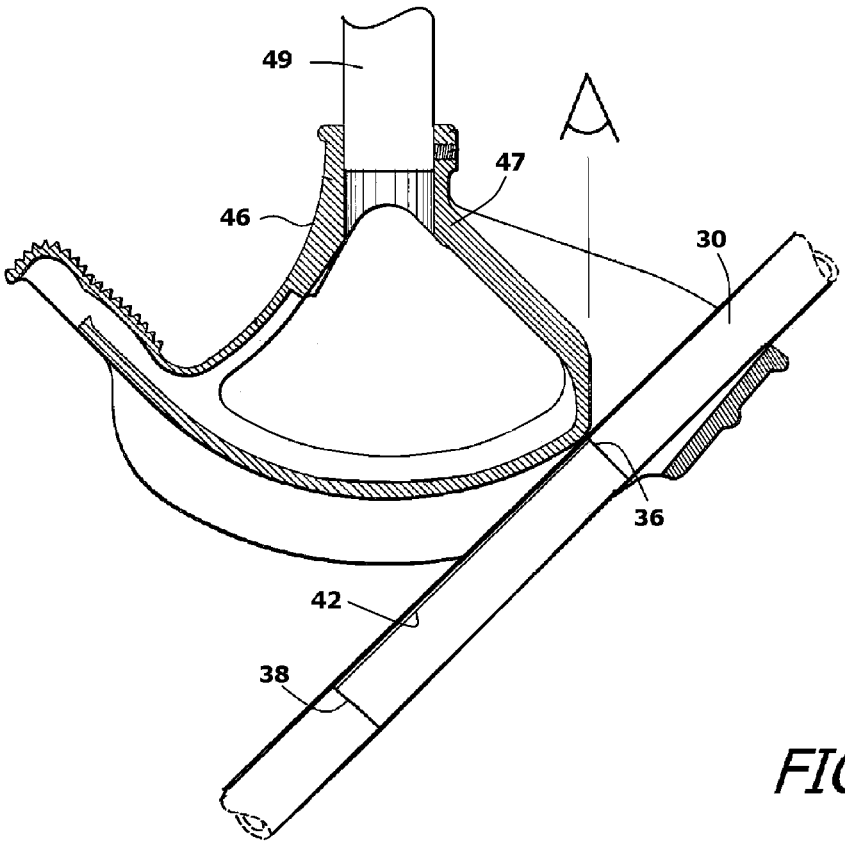
FIG. 4 shows a segment of straight pipe set in a bending tool.

Referring to FIG. 4 in conjunction with FIG. 3, it can be seen that bends are made with a bending tool 46. Any bending tool 46 capable of bending the pipe, tube or bar 30 can be used. However, in the shown embodiment a manual bending tool 46 is illustrated. The manual bending tool 46 has a curved bending head 47 that is attached to a long handle 49. The handle 49 preferably is metal and has a diameter similar to that of the concavity of the template device 10 so that the template device 10 can mount to the handle 49 when not in use.

To use the template device 10 and bending tool 46 together, a first bend 44 is made using the start line 36 as the starting point and the guideline 42 as the bending direction guide. The start line 36 is oriented at the start of the bend. This is done by eye. The first bend 44 is made so that the guideline 42 remains symmetric along in the center of the first bend 44. This is done by referencing the guideline 42 as the user brings the bending tool 46 into contact with the pipe, tube or bar 30. The guideline 42 is positioned so that it remains at the apex of the pipe, tube or bar in the exact center of where the bending tool 46 engages the pipe, tube or bar 30.

Figure 5:
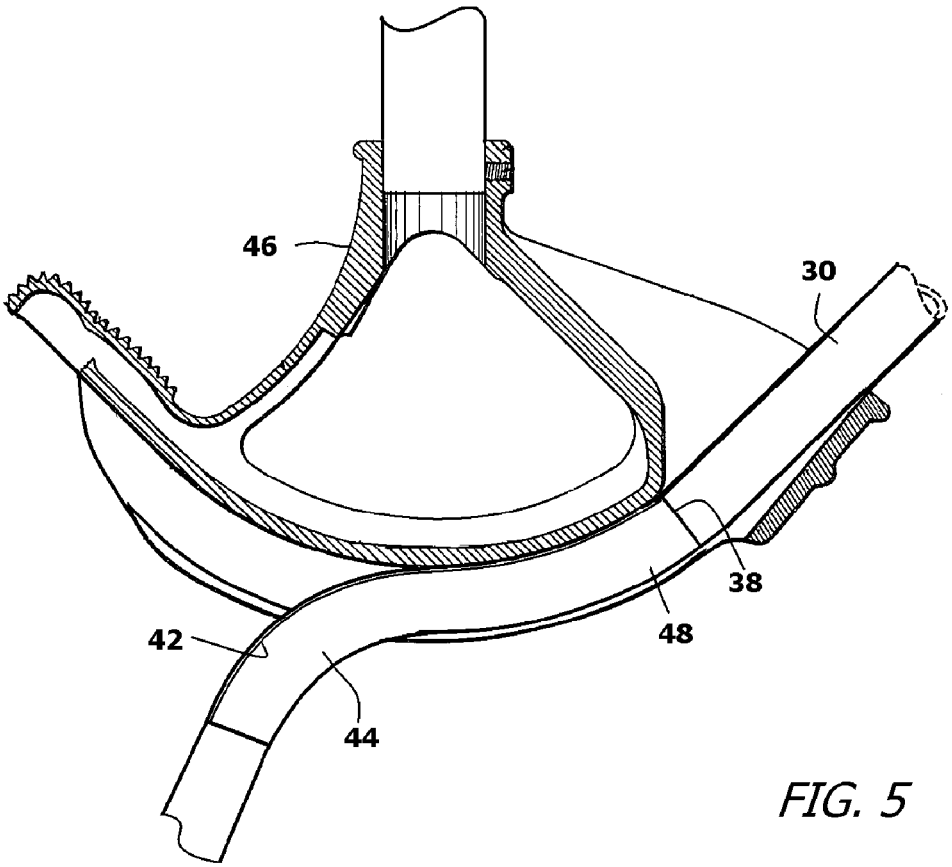
FIG. 5 shoes a segment of bent pipe set in a bending tool.

Referring to FIG. 5 in conjunction with FIG. 4 and FIG. 3, it can be seen that after the first bend 44, the pipe, tube or bar 30 has a 90 degree bend in the plane shared by the guideline 42. The guideline 42 is then again referenced to create the second bend 48. The pipe, tube or bar 30 is reversed in the bending tool 46. Using the finish line 38 as the start of the second bend 48 and the guideline 42 as the direction of the second bend 48, the user again engages the pipe, tube or bar 30 with the bending tool 46. The bending tool 46 is then used to create the second bend 48 in the same plane as the first bend 44 and the guideline 42. The end result is that the two bends 44, 48 start and finish at the exact points marked and the bends 44, 48 progress in one common plane. The completed bend is therefore proper.

Figure 6:
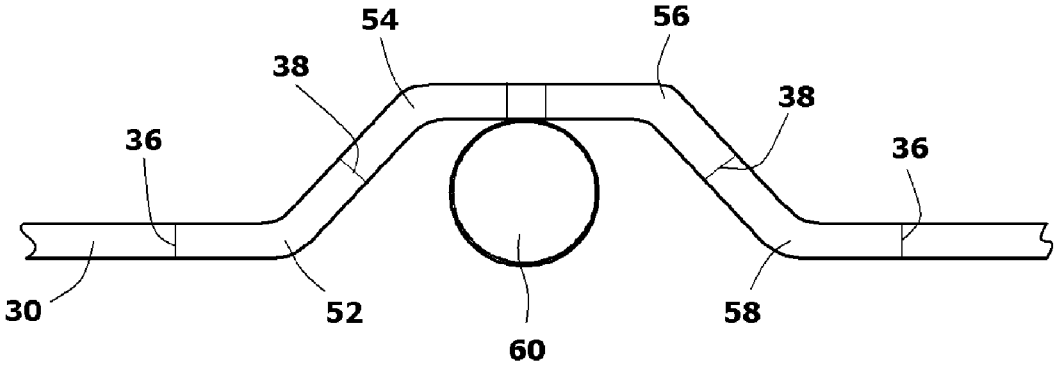
FIG. 6 shows a segment of bent pipe and an obstacle around which the bent pipe is to be fit.

Referring to FIG. 6, an alternate example is shown. In this example, a pipe, tube or bar 30 is bent with four bends 52, 54, 56, 58 in order to cause the pipe, tube or bar 30 to run around an obstacle 60. Since the pipe tube or bar 30 contains multiple distinct bends 52, 54, 56, 58, the template device is used to create multiple start lines 36 and finish lines 38 on the pipe, tube or bar 30. A single guideline is also marked down the pipe, tube or bar 30 to help keep each of the bends 52, 54, 56, 58 in the same plane.

Figure 7:
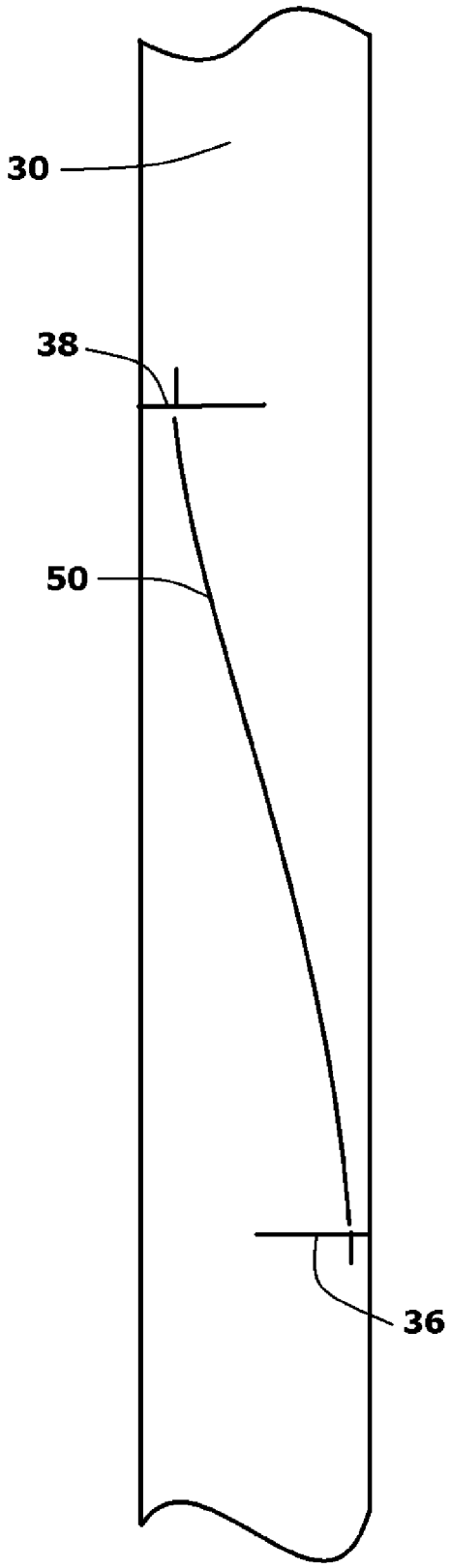
FIG. 7 shows a segment of pipe marked with a helical guideline.

The process for creating a complex bend in a pipe, tube or bar 30 is similar where the complex bend contains different bends that progress in different planes. Referring to FIG. 7 in conjunction with FIG. 2, it will be understood that the methodology for determining a start line 36 is the same. The methodology of determining how much of the pipe, tube or bar 30 will be utilized by the bend remains the same. What differs is that the finish line 38 is marked on the pipe, tube or bar 30 in a rotationally offset position. Using the rotational angle scale 34 on the template device 10, the finish line 38 can be rotated any desired degree relative the start line 36. A helical guideline 50 is then drawn on the pipe, tube or bar 30 from the center of the start line 36 to the center of the offset finish line 38.

The pipe, tube or rod 30 is bent using the start line 36 as the starting point and the helical guideline 50 as the bending direction guide. The guideline 50 is kept in the center of the bending action as the bends are made. Since the guideline 50 is helical, the bends will progress in different planes. If the guideline 50 follows a 3 degree progression, the bends will be offset by 30 degrees. The end result is that the bends start and finish at the exact points marked and the bends progress at the desired offset angle. The completed bend is therefore proper.

It will be understood that the embodiment of the present invention that is illustrated and described is merely exemplary and that a person skilled in the art can make many variations to that embodiment. For instance, the length and printed graphics on the template device can be altered to the desires of the manufacturer. All such embodiments are intended to be included within the scope of the present invention as defined by the claims.

What is claimed is:

1. A template device for use in marking lines on an elongated element in which a bend is to be formed, said template device comprising:

a body having a first end, an opposite second end, a first straight side edge, and a second straight side edge, wherein said first straight side edge and said second straight side edge are parallel and extend from said first end to said second end of said body, and wherein a concave surface, having a constant first radius of curvature, curves from said first side edge to said second straight side edge between said first end and said second end;

length indicia disposed on said body adjacent said first straight side edge and said second straight side edge; and at least one magnetic element supported by said body.

2. The template device according to claim 1, wherein said first end and said second end are parallel to each other and are perpendicular to both said first straight side edge and said second straight side edge.

3. The template device according to claim 1, further including rotational angle indicia disposed on said body.

4. The template device according to claim 1, wherein said concave surface curves along said first radius of curvature 180 degrees from said first straight side edge to said second straight side edge.

5. The template device according to claim 1, wherein said body tapers toward both said first straight side edge and said second straight side edge.

6. The template device according to claim 1, wherein said concave surface has an apex and apex marks are provided on said body along said first end and said second end.

7. A template device for use in marking lines on an elongated element in which a bend is to be formed, said template device comprising:

a body having a first end that terminates in a first plane, an opposite second end that terminates in a second plane that is parallel to said first plane, and a concave surface that extends from said first end to said second end;

length indicia on said body that indicates distance along said body from said first end; and rotational indicia on said body that indicates rotational distance along said concave surface at said first end.

8. The template device according to claim 7, wherein said body has a first side edge and a second side edge, wherein said concave surface curves from said first side edge to said second side edge.

9. The template device according to claim 8, wherein said first side edge is parallel to said second side edge and perpendicular to said first end.

10. The template device according to claim 8, wherein said body tapers along said first side edge and said second side edge.

11. The template device according to claim 8, wherein said concave surface has an apex and apex marks are provided on said body along said first end and said second end.

12. The template device according to claim 7, further including magnets supported by said body for attracting metal to said concave surface.

13. A method of marking an elongated element for bending, comprising the steps of:

providing a template with a concave surface that extends between a first end and an opposite second end;

providing a marker for marking said elongated element as guided by said template;

placing said template in abutment with said elongated element;

utilizing said marker and said template to mark a start line and a finish line on said elongated element;

utilizing said marker and said template to mark a guideline on said elongated element that extends between said start line and said finish line;

creating at least one bend in said elongated element between said start line and said finish line wherein said at least one bend progresses along said guideline.

14. The method according to claim 13, wherein said guideline is straight and perpendicular to said first end.

15. The method according to claim 13, wherein said guideline follows a helical progression between said start line and said finish line.

16. The method according to claim 13, wherein providing a template further includes providing a template with a first side edge and a second side edge, wherein said concave surface curves from said first side edge to said second side edge.

17. The method according to claim 16, wherein said first side edge is parallel to said second side edge and perpendicular to said first end.

18. The method according to claim 13, further including length indicia on said template that indicates distance along said template from said first end.

19. The method according to claim 13, further including rotational indicia on said template that indicates rotational distance along said concave surface at said first end.

* * * * *